United States Patent [19]

Fromson et al.

[11] 4,183,788

[45] Jan. 15, 1980

[54] PROCESS FOR GRAINING AN ALUMINUM BASE LITHOGRAPHIC PLATE AND ARTICLE THEREOF

[75] Inventors: Howard A. Fromson, 15 Rogues Ridge Rd., Weston, Conn. 06880; Robert F. Gracia, Scituate, Mass.

[73] Assignee: Howard A. Fromson, Weston, Conn.

[21] Appl. No.: 881,991

[22] Filed: Feb. 28, 1978

[51] Int. Cl.[2] ..... B41N 3/04; G03C 1/94

[52] U.S. Cl. ..... 430/278; 204/38 A; 204/29; 101/454; 101/455; 101/456; 101/459; 101/463

[58] Field of Search ..... 204/28, 33, 38 A, 29; 51/309; 101/454–457, 459, 463; 96/86 R, 86 P

[56] References Cited

U.S. PATENT DOCUMENTS

| | | | |
|---|---|---|---|
| 3,121,623 | 2/1964 | Nesin | 51/309 |
| 3,691,030 | 9/1972 | Stroszynski | 204/32 R |
| 3,834,998 | 10/1974 | Watanabe | 204/33 |
| 3,902,976 | 9/1975 | Walls | 204/38 A |

*Primary Examiner*—John H. Mack
*Assistant Examiner*—William Leader
*Attorney, Agent, or Firm*—Sprung, Felfe, Horn, Lynch & Kramer

[57] ABSTRACT

Planar surfaces are roughened by graining with an aqueous slurry of unfused platy, crystalline alumina. Preferably, an aluminum base with is adapted to receive a light-sensitive coating thereon to make lithographic plate is grained with said aqueous slurry.

14 Claims, No Drawings

PROCESS FOR GRAINING AN ALUMINUM BASE LITHOGRAPHIC PLATE AND ARTICLE THEREOF

BACKGROUND

This invention relates to the roughening of smooth planar surfaces such as metal or plastic and especially to the preparation of a grained aluminum base for lithographic printing plates, and more particularly to an anodized aluminum base having improved abrasion resistance and long press-life.

The art of lithographic printing depends upon the immiscibility of grease and water, upon the preferential retention of a greasy image-forming substance by an image area, and upon the similar retention of an aqueous dampening fluid by a non-image area. When a greasy image is imprinted upon a suitable surface and the entire surface is then moistened with an aqueous solution, the image area will repel the water and the non-image area will retain the water. Upon subsequent application of greasy ink, the image portion retains ink whereas the moistened non-image area repels it. The ink on the image area is then transferred to the surface of a material on which the image is to be reproduced, such as paper, cloth and the like, via an intermediary, a so-called offset or blanket cylinder, which is necessary to prevent mirror-image printing.

The type of lithographic plate to which the present invention is directed has a coating of a light-sensitive substance that is adherent to an aluminum base sheet. If the light-sensitive coating is applied to the base sheet by the manufacturer, the plate is referred to as a "presensitized plate". If the light-sensitive substance is applied to the base by the lithographer or trade plate-maker, the plate is referred to as a "wipe-on" plate. Depending upon the nature of the photosensitive coating employed, the treated plate may be utilized to reproduce directly the image to which it is exposed, in which case it is termed a positive-acting plate, or to produce an image complementary to the one to which it is exposed, in which case it is termed a negative-acting plate. In either case the image area of the developed plate is oleophilic and the non-image area is hydrophilic.

In the case of a negative working plate the surface is coated with an aqueous solution of a conventional diazo salt. The plate is dried and exposed through a photographic negative. The exposed image areas decompose and become insoluble. The unexposed, nonimage areas remain soluble. The plate is developed with a lithographic lacquer which consists of two phases—one phase containing an oleophilic resin and the other phase a hydrophilic gum. Upon application the oleophilic resin attaches to the exposed insoluble areas, while the hydrophilic phase cleans and protects the unexposed soluble nonimage areas. In this way the image areas are made oleophilic or ink-receptive and the nonimage areas are made hydrophilic or ink-repellent.

A positive plate is generally one upon which the non-image area is the portion of the light-sensitive diazo compound exposed to light while the unexposed portion is either oleophilic or adapted to be converted by chemical reaction to a hardened oleophilic ink-receptive image area.

In coating a metallic plate with a light-sensitive material it is desirable to provide an adherent, hydrophilic, abrasion resistance surface. This is best achieved by anodizing the surface of the aluminum base followed by a silicating treatment. In addition, the maximum lattitude between the oleophilic image areas and hydrophilic non-image areas is achieved.

Anodized aluminum bases for lithographic printing plates are well known and commercially available. Such plates are described in U.S. Pat. No. 3,181,461 issued May 4, 1965.

Prior to anodizing, it is common practice to grain the surface of the aluminum to increase its surface area. Graining can be carried out by mechanically treating the aluminum, for example by brush graining or ball grained or it can be grained chemically or electrochemically. Slurry brush graining has grown in importance over the past 20 years and today approximately 75% of the lithographic plates produced in the U.S. are grained using this technique.

Traditionally brush graining has been achieved by incorporating pumice or quartz into an aqueous slurry. These conventional abrasives are blocky and/or angular in shape thus presenting cutting edges for gouging or roughening surfaces in a random, nonuniform fashion. ("Brush Graining of Aluminum for Lithographic Printing Plates", J. H. Manhart, Alcoa). See also U.S. Pat. No. 3,891,516 issued June 24, 1975.

The ultimate test of the efficiency of graining is the quality of printing and the useful life of the printing plate. A good grain holds the organic coating in the image area and it also holds more water in the non-image areas making the water balance on the press less critical.

SUMMARY

The present invention provides a process for roughening smooth planar surfaces such as metal or plastic surfaces by graining with an aqueous slurry of unfused, crystalline alumina having a flat plate-like particle configuration. In a preferred embodiment, the invention provides a grained aluminum base or an anodized aluminum base for making lithographic printing plates which is characterized by greatly improved abrasion resistance as compared to aluminum bases which are grained, prior to anodizing using conventional techniques.

The process of the invention in one embodiment is thus an improvement in the process for making an aluminum base for use in making lithographic printing plates and involves graining the aluminum base with an aqueous slurry of unfused, platy, crystalline alumina. The graining is preferably carried out continuously on an aluminum web using a plurality of rotating brushes. The aluminum is preferably subsequently anodized and silicated before applying a light-sensitive coating.

DESCRIPTION

The particulate alumina used to grain in the invention is unfused, anhydrous, crystalline alumina having a plate-like or tablet-like particle configuration. The flat dimension is generally three to five times greater than the thickness. This form of alumina can be obtained from hydrated aluminas but generally it is made from alpha-alumina trihydrate.

Alpha-alumina trihydrate is a crystalline material and in its natural state is known as gibbsite or hydrargillite. It forms the main constituent of certain bauxites, such as those found in America and Africa. Alpha-alumina trihydrate is obtained directly by the Bayer process, which consists in treating the bauxite with alkali, under pressure, followed by precipitation of the resulting sodium aluminate solution by dilution and seeding with already formed hydrate. The Bayer hydrate appears as grains of relatively spherical shape, measuring 50–100 microns, which are polycrystalline aggregates, the individual crystals of which may reach a size of 1–20 microns.

Alpha-alumina trihydrate, when heated, begins to lose its water of constitution. Complete dehydration results in alpha-alumina as the final product. Unfused crystalline alumina obtained by dehydrating alpha-alumina trihydrate is a particulate material and the individual particles have a flat plate-like configuration the major dimension of which is generally five times greater than the minor dimension. They also tend to be hexagonal.

The term "unfused" is used to describe that form of alpha-alumina obtained by dehydrating alpha-alumina trihydrate (or other hydrates) without exceeding the melting or fusion temperature of the anhydrous alumina. Stated differently, alpha-alumina trihydrate is calcined or dried to reach the anhydrous alpha-alumina product without destroying the crystallinity of the alpha-alumina. If the fusion or melting temperature of the alpha-alumina is exceeded, the product becomes amorphous and ball milling or grinding causes fractures and produces blocky or flinty particles which are quite different when used in brush graining as compared to unfused crystalline alumina as used in the present invention.

Graining of aluminum according to the invention is preferably carried out continuously on a moving aluminum web using a plurality of rotating brushes. It is preferred to carry out the brush graining on a moving aluminum web using pairs of tandem brushes with an aqueous slurry of unfused crystalline alumina fed from recirculating sumps. Suitable graining equipment is commercially available from the Fuller Brush Company and was used in the examples described herein.

The unfused, crystalline alumina obtained from alpha-alumina trihydrate is characterized by a hardness on the Mohs scale of 9 (Kirk-Othmer, *Encyclopedia of Chemical Technology,* 2nd Ed., Vol. 2, pp. 42–51). This material is used to form a slurry in water. From 3 to 6 lbs. of alumina from alpha-alumina trihydrate per gallon of water are generally employed, it being generally observed that graining efficiency is not increased when going above 6 lbs. per gallon.

The geometry of unfused alumina is very unique. Unlike fused alumina, which is blocky or slivery in shape and quartz which is slivery or angular in shape; unfused alumina is hexagonal and platy. Unfused platy alumina is normally used for lapping, levelling or polishing of uneven or rough surfaces. This is achieved by a circular action whose force vector is normal to the surface. This action produces smooth surfaces. However, in accordance with this invention it has been found that unfused, platy alumina can be used to roughen a planar surface, e.g., metal sheets, if used with a rotary motion whose force vector is tangential to the surface of a moving web, specifically a brushing action.

Anodizing following the graining operation of the invention may be carried out using known techniques to form a porous anodic oxide layer on the grained aluminum surface. Sulfuric acid is the preferred electrolyte. See Kirk-Othmer *Encyclopedia of Chemical Technology,* 2nd Ed., Vol. 1, p. 978 et seq.

Cold rolled aluminum should be employed for forming printing plates according to the invention. Softer aluminum is not suitable because it will tear or rip when engaged by the lock-up device of a printing press. Preferred aluminum sheet generally has a temper of between H12 and H19 where direct cold reduction is employed or between H22 and H27 where a combination of cold reduction and back annealing are employed, as specified by the American Aluminum Association in *Aluminum Standards and Data,* published by the Association.

Aluminum printing plates can be made in any fashion known in the art, for example as taught by the following
U.S. Pat. No. 2,714,066, Jewitt et al, July 26, 1955;
U.S. Pat. No. 2,741,981, Frost, Apr. 17, 1956;
U.S. Pat. No. 2,791,504, Plambeck, May 7, 1957;
U.S. Pat. No. 3,062,648; Grawford, Nov. 6, 1962;
U.S. Pat. No. 3,181,461, Fromson, May 4, 1965;
U.S. Pat. No. 3,220,346, Strickler, Nov. 30, 1965;
U.S. Pat. No. 3,280,734, Fromson, Oct. 25, 1966; and
U.S. Pat. No. 3,338,164, Webers, Aug. 29, 1967.

Especially preferred is an anodically oxidized aluminum base having an aluminum oxide surface which is initially porous after anodic oxidation and subsequently treated with an alkali metal silicate and sealed prior to application of a light-sensitive coating. This is the subject of U.S. Pat. No. 3,181,461 referred to above.

It is preferred to continuously anodize aluminum after graining utilizing the anodizing techniques described in patents U.S. Pat. No. 3,865,700 issued Feb. 11, 1975, and U.S. Pat. No. 3,920,525 issued Nov. 18, 1975. If desired, the aluminum base can be provided with a composite anodized and discontinuously electroplated surface prior to application of the light-sensitive coating as taught in patent U.S. Pat. No. 3,929,594 issued Dec. 30, 1975.

The light-sensitive coating for making lithographic plates has one solubility in relation to a solvent in a state before exposure to actinic radiation and another solubility in relation to said solvent in another state after exposure to actinic radiation, said light-sensitive coating being soluble in said solvent in one of said states and being insoluble in said solvent in its other state.

The light-sensitive layer or coating may be formed from a host of photochemical materials known in the art. Such light-sensitive materials include dichromated colloids, such as those based on organic colloids, gelatin, process glue, albumens, caseins, natural gums, starch and its derivatives, synthetic resins, such as polyvinyl alcohol and the like; unsaturated compounds such as those based on cinnamic acid and its derivatives, chalcone type compounds, stilbene compounds and the like; and photopolymerizable compositions, a wide variety of polymers including vinyl polymers and copolymers such as polyvinyl alcohol, polyvinyl acetals, polyvinyl acetate vinyl sorbate, polyvinyl ester acetal, polyvinyl pyrrolidone, polyvinyl butyrol, halogenated polyvinyl alcohol; cellulose based polymers such as cellulose-acetate hydrogenphthalate, cellulose alkyl ethers; ureaformalehyde resins; polyamide condensation polymers; polyethylene oxides; polyalkylene ethers, polyhexamethylene adipamide; polychlorophene, polyethylene glycols, and the like. Such compositions utilize as initiators carbonyl compounds, organic sulphur compounds, peroxides, redox systems, azo and diazo compounds, halogen compounds and the like. These and other photochemical materials including their chemistry and uses are discussed in detail in a text entitled [Light-Sensitive Systems, Jaromir Kosar, John Wiley and Sons, Inc., New York 1965. Diazo resins are particularly preferred.

The light-sensitive coating is referred to for ease in understanding as being soluble in relation to a solvent before exposure to actinic radiation and insoluble with respect to said solvent after exposure to actinic radiation, it being understood that light-sensitive materials which behave in the opposite manner, that is first insoluble and then soluble after exposure, are within the purview of the present invention.

The terms "soluble" and "insoluble" are intended to convey the meaning generally accepted and understood in the art of exposing and developing images utilizing light-sensitive systems. For example, a light-sensitive material is considered to be soluble when it can be readily removed by washing with a particular solvent at normal operating temperatures such as room temperature and insoluble when it is not removed upon exposure to a particular solvent under the same or similar temperature conditions.

If desired, the light-sensitive printing plate can be provided with a tough, wear-resistant protective layer as taught in patent U.S. Pat. No. 3,773,514 issued Nov. 20, 1973. If desired, graining with platy alumina can be carried out in combination with other abrasives such as quartz or conventional graining can precede or follow graining according to the invention.

The present invention wll be more fully understood from the following examples which are intended to illustrate the invention without limiting same.

EXAMPLE 1

Multiple graining units are installed in a continuous web anodizing line. The placement of these units relative to the entire line is after the degreasing section and prior to the anodizing section. Graining is achieved by supplying an aqueous, abrasive slurry at the point of contact between rotary brush and moving aluminum web. This is accomplished by sumps in which the slurry is stored, mixed, and circulated to the web where the work is done. For comparison, a slurry for one graining unit is prepared by adding FFF Pumice (5 lbs.) and 6/0 quartz (100 lbs.) to 30 gallons of water under high speed agitation. A second sump is charged with 5 lbs. FFF Pumice, 100 lbs. 7/10 quartz and 30 gallons of water.

A coil of aluminum 0.012 inches thick, 24 inches wide is mounted on the production line. The speed of the web through the line is set at 50 ft./minute. The sequence of processing is as follows: degreasing, rinsing, graining, cleaning, rinsing, anodizing rinsing, silicating, rinsing, and drying.

Samples 17 in.×6 in. are then taken for testing. The anodic oxide coat weight is determined by stripping and weighing—this is typically 1.2–1.5 mg./in.$^2$. A 17 in.×6 in. sample is coated with a light-sensitive diazo compound (3% solution-Fairmont Chem. Co.) and dried. The sample is given a blanket exposure, 1½ min., on a Nu-Arc exposure unit. The entire sample is then lacquered (solid) with black Lacquer (Fairmont Chem. Co.) and dried. The lacquered sample is then placed on a Gardner Straight Line Washability and Abrasion tester. Abrasion is accomplished with a nylon scouring pad manufactured by Metal Textiles Div., General Cable Corp. The pad (5¼ in.×1.75 in.) is weighted with 1¾ lbs. The test is run for 150 cycles. The results of this abrasion test are compared with four standard samples empirically derived over many graining trials. They are designated poor–good–very good–excellent. This test is easy to judge because samples of lesser quality begin to show white scratch marks parallel to the direction of the abrasion. These marks are very obvious and easy to quantify because of the black background. In this example, using quartz, the results are rated poor (many white scratch marks) indicating a product of inferior quality.

EXAMPLE 2

A brush graining-anodizing trial similar to example 1 is run except the second graining unit is charged with 30 gals. of water and 100 lbs. white, unfused crystalline alumina made from alumina trihydrate having an average particle size of 18 microns. Samples are taken and tested in example 1. The abrasion test shows very good results (little or no scratch marks) indicating a product of good quality.

EXAMPLE 3

A brush graining-anodizing trial similar to example 1 is run except that the graining units are charged with identical slurries consisting of 30 gals. water and 100 lbs. of Alumina MCA 820 (white, unfused alumina sold by the Norton Co.).

Samples and tests are made similar to example 2. The abrasion tests give excellent results (no scratch marks) indicating a superior product.

EXAMPLE 4

A brush graining-anodizing run is made similar to example 3 except that the line speed is set at 100 ft./min.

Samples and tests are run as in example 1. The oxide coat weight is approximately 50% lower, namely 0.8mg./in.$^2$ in example 1, and the abrasion tests show very good results indicating a product as good as that achieved in example 2.

EXAMPLE 5

A brush graining-anodizing run is made similar to example 1 except that the slurry charge in both sumps contain 100 lbs. of Alundum Abrasive, size 180 (white friable fused Aluminum Oxide). This material is characterized by its blocky shape. (Purchased from the Norton Company).

Samples taken and tests were run for abrasion resistance. The test showed poor abrasion resistance.

EXAMPLE 6

A brush graining-anodizing run is made similar to example 5 using a slurry charge of Micrograded, fused, Alundum, size 17.5 in one sump and fused Alundum 180 in the other. Abrasion tests showed similar results to that of example 5.

EXAMPLE 7

A brush graining-anodizing run was made using fused Alundum 180 in one sump and unfused MCA 820 in the other sump. The line speed was 55 ft./min. Samples were taken and abrasion tests were made. The test results were very good showing the unusual upgrading effect, on abrasion resistance, that the unfused alumina has in this process.

EXAMPLE 8

A brush graining trial similar to example 5 was run except that both sumps contained 30 gals of water and 100 lbs of Tabular Alumina, T-16,−325 mesh, purchased from Alcoa. Abrasion tests showed very good results.

EXAMPLE 9

A brush graining trial similar to example 5 was run using 100 lbs. of Calcined Alumina A-2 (Alcoa) in each sump. This material produced a grain that showed very good abrasion resistance as measured in example 1.

EXAMPLE 10

Copper, brass and stainless steel; Mylar, polystyrene, triacetate, polyacetate and vinyl sheets are surface roughened using the brush roughening techniques described in example 3. In each case the treated surfaces have a uniform grained appearance with a greatly increased surface area. The metallic surfaces act as substrates in electrolytic and chemical etching techniques where photo-sensitive resists or plain resin resists are used. On plastics, the graining technique is used to roughen the planar surfaces for anchoring subsequent coatings.

What is claimed is:

1. Process for making a lithographic printing plate comprising an aluminum base which comprises graining said aluminum base with an aqueous slurry comprising unfused, platy crystalline alumina while applying a rotary brushing motion whose force vector is predominantly tangential to the surface of the aluminum.

2. Process of claim 1 wherein the alumina is obtained from alpha-alumina trihydrate.

3. Process of claim 1 wherein the alumina has an ultimate particle size of from about 1 to about 20 microns.

4. Process of claim 1 wherein the aluminum base is anodized after graining.

5. Process of claim 4 wherein the base is silicated after anodizing.

6. Process of claim 1 wherein the graining is carried out continuously on an aluminum web using a plurality of rotating brushes.

7. Process of claim 6 wherein the graining is carried out using one or more pairs of rotating brushes and the slurry is recirculated.

8. Lithographic printing plate comprising an aluminim base, said base being grained with an aqueous slurry of unfused, platy crystalline alumina while applying a rotary brushing motion whose force vector is predominantly tangential to the surface of the aluminum base.

9. Aluminum base of claim 8 wherein the base is anodized after graining.

10. Aluminum base of claim 8 wherein the base is silicated after graining.

11. Lithographic printing plate comprising an aluminum base coated with a light-sensitive material, said base being grained with an aqueous slurry comprising unfused, platy crystalline alumina while applying a rotary brushing motion whose force vector is predominantly tangential to the surface of the aluminum base, before application of said light-sensitive coating.

12. Lithographic printing plate of claim 11 which is anodized after graining before application of said light sensitive coating.

13. Lithographic printing plate of claim 11 which is silicated after graining and before application of said light sensitive coating.

14. Lithographic printing plate of claim 11 which is anodized and silicated after graining and before application of said light sensitive coating.

* * * * *

UNITED STATES PATENT AND TRADEMARK OFFICE

CERTIFICATE OF CORRECTION

PATENT NO. : 4,183,788

DATED : January 15, 1980

INVENTOR(S) : Howard A. Fromson

It is certified that error appears in the above-identified patent and that said Letters Patent are hereby corrected as shown below:

Col. 2, l. 1,2 "lattitude" should read -- latitude --.

Col. 5, l. 45 "7/10" should read -- 7/0 --.

Col. 8, l. 9,10 "aluminim" should read -- aluminum --.

Signed and Sealed this

*Eighth* Day of *July 1980*

[SEAL]

*Attest:*

SIDNEY A. DIAMOND

*Attesting Officer*

*Commissioner of Patents and Trademarks*